US007134770B2

(12) United States Patent
Barlian et al.

(10) Patent No.: US 7,134,770 B2
(45) **Date of Patent: *Nov. 14, 2006**

(54) INDICATING LIGHT

(75) Inventors: Reinhold Barlian, Bad Mergentheim (DE); Karl-Heinz Lux, Weikersheim (DE)

(73) Assignee: Bartec GmbH, Bad Mergentheim (DE)

( * ) Notice: Subject to any disclaimer, the term of this patent is extended or adjusted under 35 U.S.C. 154(b) by 15 days.

This patent is subject to a terminal disclaimer.

(21) Appl. No.: 10/387,816

(22) Filed: Mar. 13, 2003

(65) Prior Publication Data

US 2003/0210552 A1 Nov. 13, 2003

(30) Foreign Application Priority Data

Mar. 13, 2002 (DE) ..... 102 10 919

(51) Int. Cl.
*F21V 5/00* (2006.01)

(52) U.S. Cl. ..... 362/338; 362/186; 362/800

(58) Field of Classification Search ..... 362/311, 362/326, 338, 340, 186, 363, 545, 555, 800
See application file for complete search history.

(56) References Cited

U.S. PATENT DOCUMENTS 6,517,213 B1 * 2/2003 Fujita et al. ..... 362/800
6,666,689 B1 * 12/2003 Savage, Jr. ..... 362/555

* cited by examiner

*Primary Examiner*—Stephen F Husar
(74) *Attorney, Agent, or Firm*—Horst M. Kasper

(57) ABSTRACT

Indicating light for optical display, comprising a housing including electrically conducting components, a light-emitting diode, a light rod and a round cap.

30 Claims, 3 Drawing Sheets

INDICATING LIGHT

The invention refers to an indicting light for optical display.

Most prior art indicators, equipped with light-emitting diodes, suffer of inadequate light distribution and uneven lighting, thus making indicators worse than comparable lighting systems based on incandescent lamps. There are various types of light-emitting diodes resulting in highly variable lighting patterns. A light-emitting diode having a tight lighting angle will generate light, sharp spot lighting but no surface lighting. A light-emitting diode having a wide lighting angle will generate sufficient brightness, in order to meet requirements for emitting a clear signal. It is prior art to use a printed circuit board having a multitude of light-emitting diodes bonded to it, a so-called multi-LED. However, this variation is relatively expensive, and irrespective of its price, only marginally better lighting will be the result. In addition, it will generate much heat, thus limiting its use in explosive atmospheres, based on standard specifications in accordance with DIN EN 50014/18/19. In addition, it is a known fact that standard light-emitting diodes must be arranged in circles and must provide a lighting area comprising a multitude of small lenses. Alternating light and dark spots occurring in this, however, are a nuisance, in particular when symbols or letters are arranged on the lighting surface. Furthermore, this arrangement is expensive.

It is the object of the present invention to create an indicating light for optical display, offering a high functionality by simple means, based on a low operating temperature and bright and even lighting.

This object of the invention has been solved by the features of claim 1.

Preferred embodiments and developments of the invention are characterised by the features of the subclaims.

For other benefits and essential details of the invention, see the following specification and the drawing, showing as an example a preferred embodiment in a single schematic section.

This problem is resolved by an indicating light for optical display, comprising a housing with electrical lead parts, a light-emitting diode arranged in a light rod which has a translucent round head the inner side of which facing the light-emitting diode has a refracting fine pearl structure.

Figure 1:
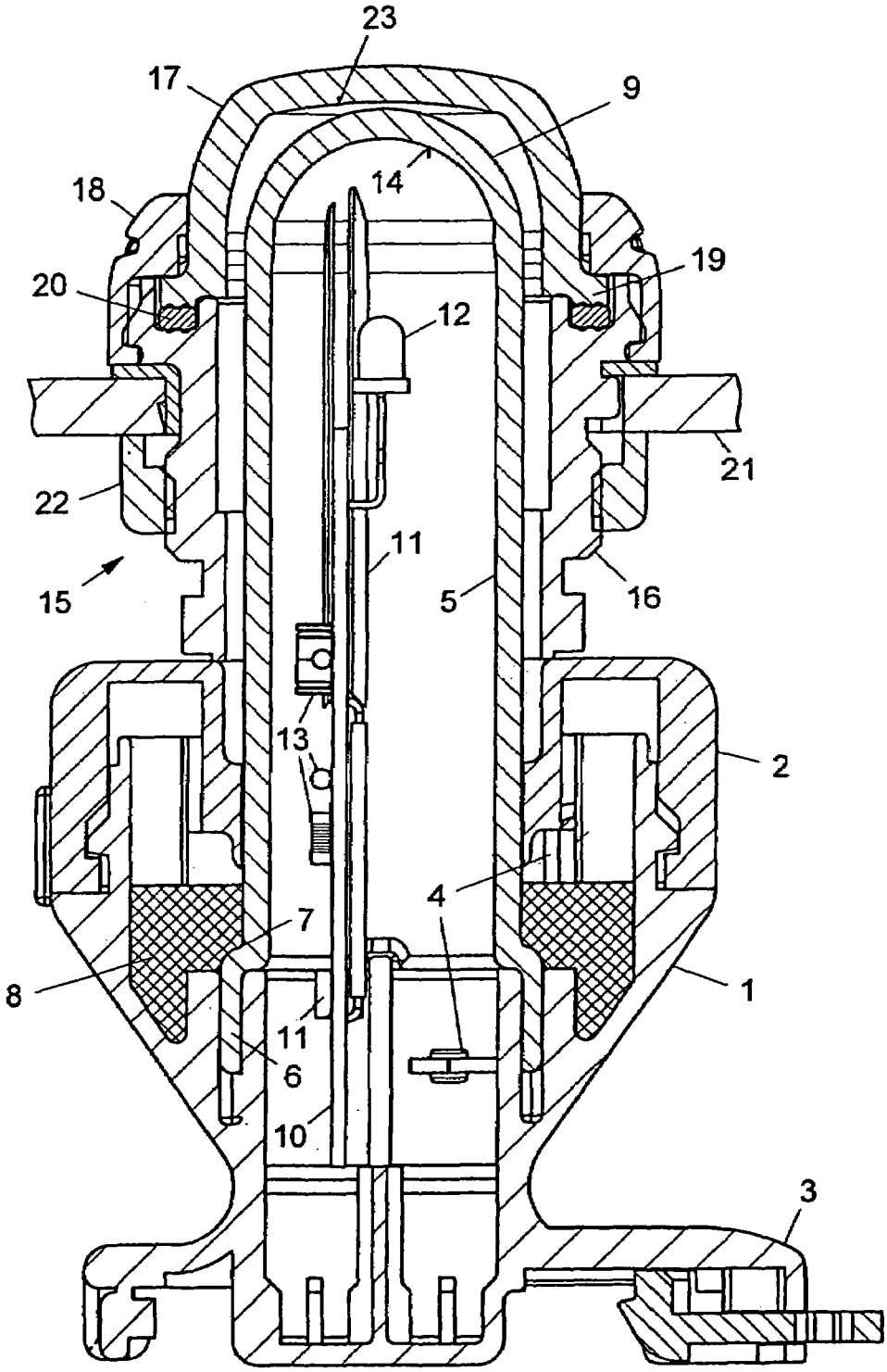
FIG. 1 is a front section view of an indicating light embodying the principles of the present invention.
Figure 2:
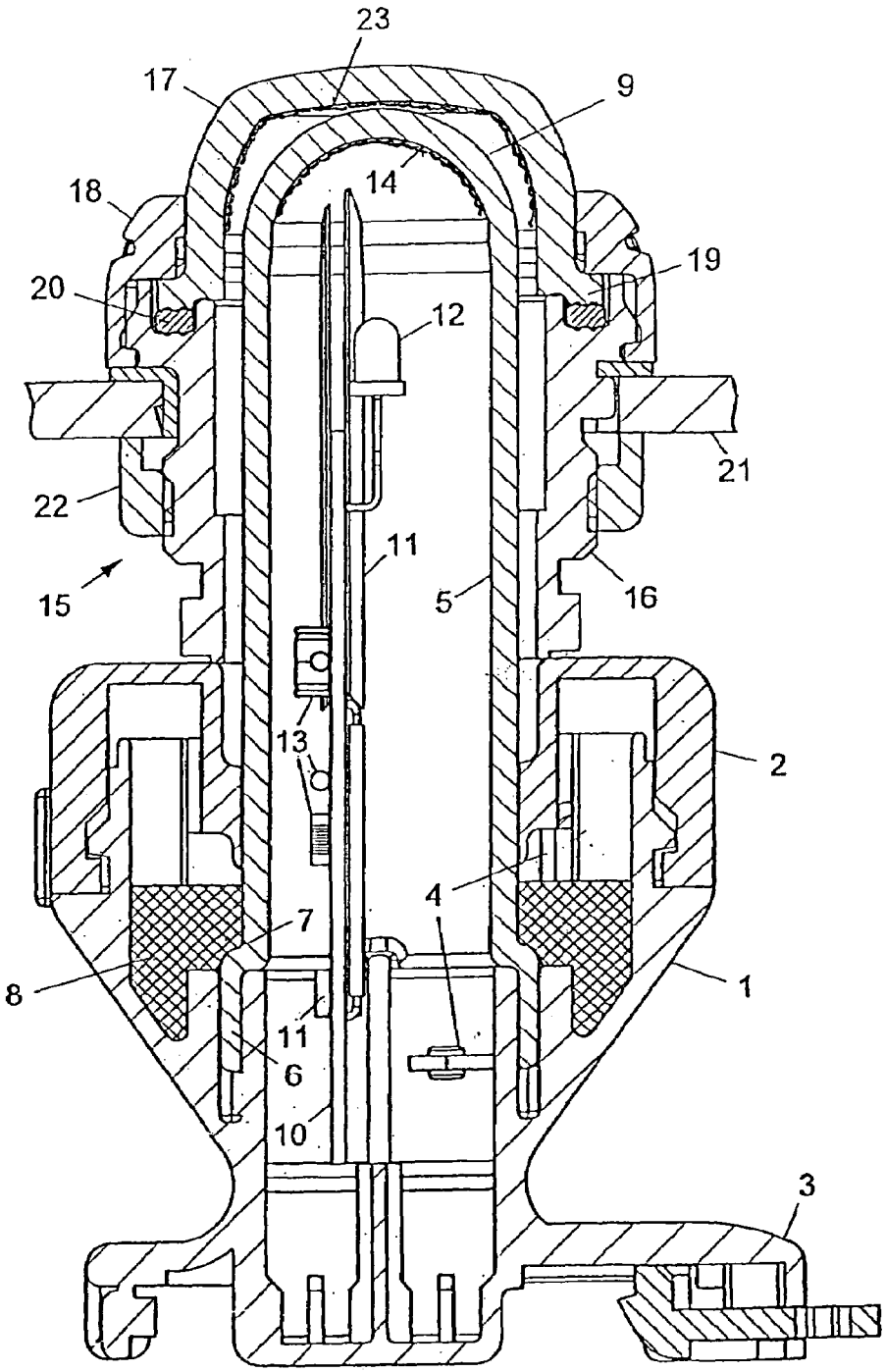
FIG. 2 shows an embodiment similar to the embodiment of FIG. 1, however presenting a fine pearl structure.
Figure 3:
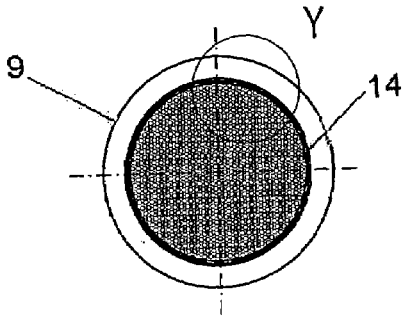
FIG. 3 is a bottom view of the inner side of the round head with a fine pearl-shaped structure.
Figure 4:
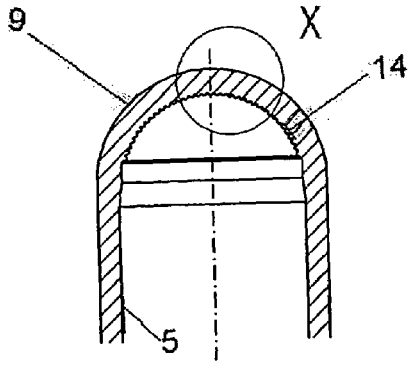
FIG. 4 is a longitudinal sectional view of the inner side of the round head of FIG. 3 with a fine pearl-shaped structure.
Figure 5:
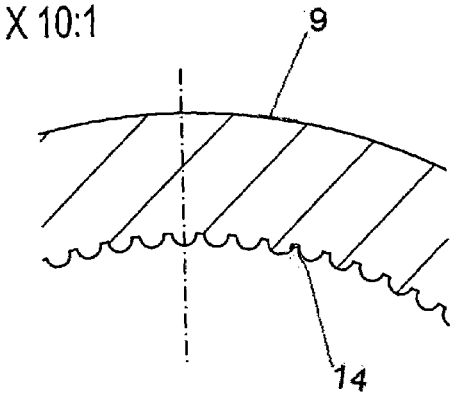
FIG. 5 is an enlarged longitudinal sectional view of the inner side of the round head of FIG. 4 with a fine pearl-shaped structure.
Figure 6:
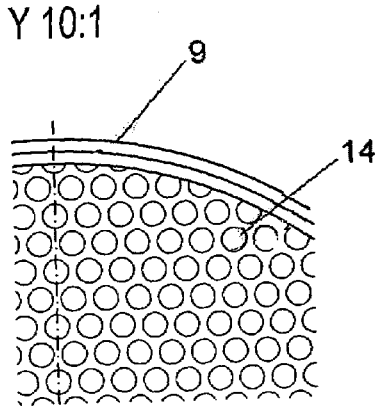
FIG. 6 is an enlarged bottom view of the inner side of the round head of FIG. 3 with a fine pearl-shaped structure.

The indicating light according to the invention comprises a housing 1, including a cover 2 and a foot section 3 that may be fastened to a sectional rail not shown here. The housing 1 comprises electrically conducting components 4 for the connection of electrical supply and terminal leads and/or connecting terminals.

In addition, the housing 1 comprises a light rod 5, made of an opaque material, predominantly designed as a circular cylindrical tube extending through the cover and projecting over it. The part of the light rod 5 within the housing 1 comprises a rectangular tubular section 6 anchored in the housing 1, the rectangular dimension of which is somewhat larger than the remaining part of the light rod 5. At the beginning of the tubular section 6, a shoulder 7 is formed because of the larger rectangular dimension. In this area, the light rod 5 has been surrounded by a moulding resin 8, extending into the shoulder 7. The moulding resin 8 has been cast to comply with standard requirements of explosion protection in accordance with DIN EN 50014/18/19.

The end section of the tubular end section 6 located away from the light rod 5, has been designed as a round head 9, thus closing the tubular light rod 5. The light rod 5 is a solid piece of material, with the wall thickness both at the round head 9 and the tubular end section 6 and between these end sections being essentially identical. For use in explosive areas, the light rod 5 may be conveniently designed as a pressure-resistant capsule in compliance with the requirements of the explosion protection standard DIN EN 50014/18/19.

A circuit board 10 may be arranged within the light rod 5, preferably held between web-shaped holding ribs 11. A light-emitting diode may be arranged on the circuit board 10 just below the round head 9 and aligned towards the latter. In addition, the circuit board 10 may be provided with electronic components 13 supporting the function of the light-emitting diode 12.

In order to obtain even and bright lighting, at least the inner side 14 of the round head 9, facing the light-emitting diode 12, may be of a fine pearl-shaped structure, preferably designed to allow a multitude of globular and/or pearl-shaped elevations, alternating with a multitude of small troughs being directly located next to each other, thus not making the inner side 14 smooth but finely roughened. A finely roughened inner side structure like this may be preferably obtained by erosion, etching, grit blasting or any other appropriate design of the mould surface. This finely roughened inner side structure has the effect that any light emitted by the light-emitting diode 12 will diffract and be captured on the entire inner side 14 of the round head 9, thus making the round head as such shine as a uniform large luminous element. Moreover, it may be of benefit to colour the light rod 5 but at least the round head 9, diffusely milky or milky/coloured and fluorescent. This colouring would accentuate translucency in a manner that a certain inherent shine of the light rod 5 and/or the round head 9 would occur, thus making lighting more even and intensive.

As also shown in the drawing, the indicating light may comprise a front casing 15, covering the part of the light rod 5 projecting from the cover 2. The front casing 15 comprises an insert housing 16 surrounding the light rod 5 like a tube and a light cap 17, attached to the insert housing 16 by means of a front ring 18. A sealing ring 20 is arranged between the edge 19 of the light cap 17 and the insert housing 16. A threaded nut 22 may be rotatably arranged on the insert housing 16 for attaching the front casing 15 in a secure position, due to being firmly screwed against the inside of the mounting wall 21.

The light cap 17 is made of an opaque material and covers the round head 9, leaving a small clearance. The inside 23 of the light cap 17, facing the round head 9, may also be of a fine pearly-shaped structure. This structure may be designed to cause a multitude of small pearl-shaped elevations and a multitude of small troughs to be alternative directly positioned next to each other, thus finely roughening the inside 23. This finely roughened inside structure may be essentially identical with the finely roughened internal structure of the round cap 9 and may be made by an identical production process. In addition, it may also be beneficial to colour the light cap 17 diffusely milky or milky/coloured and fluorescent, in order to reduce its translucency, with an inherent shine of the light cap 17 and/or more even and intensive lighting being achieved. In addition, optimally even and uniform lighting may be achieved by both the round cap 9 of the light rod 5 and the light cap 17 of the front casing 15 being coloured according to the light and colour wave lengths of the light-emitting diode 12.

Indicating light for optical display, comprising a housing including electrically conducting components, a light-emitting diode, a light rod and a round cap.

The invention claimed is:

1. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure.

2. Indicating light according to claim 1, characterised in that at least the round head (9) of the light rod (5) has a milky tinge.

3. Indicating light according to claim 1, characterised in that at least the round head (9) of the light rod (5) is of a fluorescent milky colour.

4. Indicating light according to claim 1, characterised in that the light rod (5) is formed in one piece with the round head (9) and from the same material.

5. Indicating light according to claim 1, characterised in that the light rod (5) is formed as a cylindrical tube one end of which is closed by the round head (9).

6. Indicating light according to claim 1, characterised in that the light rod (5) is fixed in the housing (1) by a tube end section (6) of the light rod (5) which is away from the round head (9).

7. Indicating light according to claim 1, characterised in that a printed circuit board (10) with the light-emitting diode (12) and electronic components (13) arranged on it is provided within the light rod (5).

8. Indicating light according to claim 1, characterised in that a front casing (15) is attachable to a mounting wall (21) which is arranged between a front ring (18) and a threaded nut (22) located at an insert housing (16).

9. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein part of the light rod (5) in the housing (1) is cast over with moulding resin (8) according to the explosion protection requirements.

10. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein the light rod (5) is designed as a pressure-resistant capsule for the purpose of way of explosion protection.

11. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein the housing (1) is closed by a cover (2) into which the light rod (5) protrudes.

12. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein a printed circuit board (10) is securely located in a position between holding ribs (11) in the light rod (5).

13. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein a front casing (15) extends over the part of the light rod (5) which protrudes past a cover (2) of the housing (1).

14. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein a front casing (15) has a translucent light cap (17) extending over the round head (9) of the light rod (5).

15. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein an inner side (23) of a light cap (17) facing the round head (9) of the light rod (5) has a refracting fine pearl structure.

16. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein the fine pearl structure of the inner side (14) of the light rod (5) and the fine pearl structure of the inner side (23) of a light cap (17) are essentially identical.

17. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein a light cap (17) has a milky or milky/coloured fluorescent tint.

18. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein the round head (9) of the light rod (5) and a light cap (17) are tinted to suit the wavelength of the light colour of the light-emitting diode (12).

19. Indicating light for optical display, comprising a housing (1) with electrical lead parts (4), a light-emitting diode (12) arranged in a light rod (5) which has a translucent round head (9) an inner side (14) of which facing the light-emitting diode (12) has a refracting fine pearl structure, wherein a light cap (17) is held by a front ring (18) which can be attached at an insert housing (16).

20. An indicating light for an optical display, comprising a housing (1);

electrical lead parts (4) disposed in the housing;

a light rod (5);

a light-emitting diode (12) arranged in the light rod (5), wherein the light rod has a translucent round head (9) and wherein an inner side (14) of the translucent round head (9) and facing the light-emitting diode (12) has a refracting fine pearl structure.

21. Indicating light according to claim 20 wherein the housing (1) includes a foot section (3) fastened to a sectional rail.

22. Indicating light according to claim 20 wherein the light rod (5) comprises a rectangular tubular section (6) fixed in the housing (1), wherein the tubular section (6) is disposed relatively remote from the round head (9) and comprises a rectangular dimension larger than a dimension of the remaining part of the light rod (5) and forms a shoulder (7) at the beginning of the tubular section (6), wherein in area near the shoulder (7), the light rod (5) is surrounded by a cast molding resin (8), extending into the shoulder (7).

23. Indicating light according to claim 21 wherein the light rod (5) is made of an opaque material, and wherein light rod (5) is a solid piece of material, with a wall thickness both at the round head (9) and at the tubular end section (6), and between the round head (9) and the tubular end section (6) being essentially constant.

24. Indicating light according to claim 20 wherein at least the inner side (14) of the round head (9), facing the light-emitting diode (12), is of a fine pearl-shaped structure, not smooth but finely roughened by erosion, etching, grit blasting or any other appropriate forming of the mould surface, to allow a multitude of globular and/or pearl-shaped elevations, alternating with a multitude of small troughs being directly located next to each other, wherein any light emitted by the light-emitting diode (12) will diffract and be captured on the entire inner side (14) of the round head (9), thus making the round head (9) as such shine as a uniform large luminous element.

25. Indicating light according to claim 21 wherein the indicating light further comprises a front casing (15), covering the part of the light rod (5) projecting from the cover (2), wherein the front casing (15) comprises the insert housing (16) surrounding the light rod (5) like a tube and a light cap (17), attached to the insert housing (16) by means of a front ring 18, and wherein a sealing ring 20 is arranged between an edge (19) of the light cap (17) and the insert housing (16), and wherein the light cap (17) is made of an opaque material and covers the round head (9), leaving a small clearance.

26. Indicating light according to claim 25 wherein the inside (23) of the light cap (17), facing the round head (9), is of a fine pearly-shaped structure essentially identical with the finely roughened internal structure of the round head (9) and may be made by an identical production process, to cause a multitude of small pearl-shaped elevations and a multitude of small troughs to be alternative directly positioned next to each other, thus finely roughening the inside (23), and wherein the light cap (17) is coloured diffusely milky or milky/coloured and fluorescent, in order to reduce its translucency, with an inherent shine of the light cap (17) and more even and intensive lighting being achieved.

27. Indicating light according to claim 25 wherein both the round head (9) of the light rod (5) and the light cap (17) of the front casing (15) are coloured according to the light and colour wave lengths of the light-emitting diode (12), to achieve an optimally even and uniform lighting.

28. An indicating light for an optical display, comprising a housing (1);

electrical lead parts (4) disposed in the housing (1);

a tubular light rod (5);

a light-emitting diode (12) arranged in the tubular light rod (5), a translucent round head (9) which closes the tubular light rod (5), wherein an inner side (14) of the translucent round head (9) facing to the light-emitting diode (12) has a a multitude of small globular elevations or/and small troughs being directly located next to each other.

29. An indicating light for an optical display, comprising a housing (1);

electrical lead parts (4) disposed in the housing (1);

a tubular light rod (5);

a light-emitting diode (12) arranged in the tubular light rod (5), an insert housing (16) surrounding the light rod (5), a light cap (17), attached to the insert housing (16) by means of a front ring (18), wherein the light cap (17) covers the round head (9) with a small clearance, and an inner side (23) of a light cap (17) facing the round head (9) of the light rod (5) has the multitude of small globular elevations or/and small troughs being directly located next to each other.

30. An indicating light for an optical display, comprising a housing (1);

electrical lead parts (4) disposed in the housing (1);

a tubular light rod (5);

a light-emitting diode (12) arranged in the tubular light rod (5), a translucent round head (9) which closes the tubular light rod (5), wherein an inner side (14) of the translucent round head (9) facing to the light-emitting diode (12) has a a multitude of small globular elevations or/and small troughs being directly located next to each other;

an insert housing (16) surrounding the light rod (5), a light cap (17), attached to the insert housing (16) by means of a front ring (18), wherein the light cap (17) covers the round head (9) with a small clearance, and an inner side (23) of a light cap (17) facing the round head (9) of the light rod (5) has the multitude of small globular elevations or/and small troughs being directly located next to each other.

* * * * *